US012253073B2

(12) United States Patent
Speijers

(10) Patent No.: US 12,253,073 B2
(45) Date of Patent: Mar. 18, 2025

(54) CYCLIC OPERATING PUMPING METHOD AND SYSTEM

(71) Applicant: ALTOP PATENTS III B.V., Beek (NL)

(72) Inventor: Sam Speijers, Middelaar (NL)

(73) Assignee: ALTOP PATENTS III B.V., Beek (NL)

( * ) Notice: Subject to any disclaimer, the term of this patent is extended or adjusted under 35 U.S.C. 154(b) by 347 days.

(21) Appl. No.: 17/625,033

(22) PCT Filed: Jul. 25, 2019

(86) PCT No.: PCT/EP2019/070022

§ 371 (c)(1),
(2) Date: Jan. 5, 2022

(87) PCT Pub. No.: WO2021/013350

PCT Pub. Date: Jan. 28, 2021

(65) Prior Publication Data

US 2022/0282723 A1 Sep. 8, 2022

(51) Int. Cl.
*F04B 43/10* (2006.01)
*F04B 43/00* (2006.01)
(Continued)

(52) U.S. Cl.
CPC ..... *F04B 43/10* (2013.01); *F04B 43/0018* (2013.01); *F04B 43/0072* (2013.01);
(Continued)

(58) Field of Classification Search
CPC ..... F04B 43/0018; F04B 43/0072; F04B 43/088; F04B 43/10; F04B 43/1133; F04B 47/00
(Continued)

(56) References Cited

U.S. PATENT DOCUMENTS 2,699,729 A * 1/1955 Stevens ..... F04B 47/04 91/345
2,747,510 A * 5/1956 Von Seggern ..... F04B 15/023 417/900

(Continued)

FOREIGN PATENT DOCUMENTS

CN 101529093 A 9/2009
WO WO-9514171 A1 * 5/1995 ..... F04B 43/0072
WO 2017019560 A1 2/2017

OTHER PUBLICATIONS

International Search Report and Written Opinion in corresponding International Patent Application No. PCT/EP2019/070022 dated Nov. 4, 2019.

(Continued)

*Primary Examiner* — Christopher S Bobish
(74) *Attorney, Agent, or Firm* — Steven M. Koehler; Westman, Champlin & Koehler, P.A.

(57) ABSTRACT

A method of transporting a material includes at least one series of interconnected tube sections that can be opened or closed. At least one downstream tube section holds the material to be transported. A liquid jet is generated which accelerates the held material upstream out of at least the first downstream tube section into at least one opening upstream tube section which then holds a material part waiting for a next liquid jet to propagate that part to the next upstream tube section.

16 Claims, 2 Drawing Sheets

(51) Int. Cl.
*F04B 43/08* (2006.01)
*F04B 43/113* (2006.01)
*F04B 47/00* (2006.01)

(52) U.S. Cl.
CPC ..... *F04B 43/088* (2013.01); *F04B 43/1133* (2013.01); *F04B 47/00* (2013.01)

(58) Field of Classification Search
USPC ..... 417/86, 87, 151
See application file for complete search history.

(56) References Cited

U.S. PATENT DOCUMENTS 3,154,021 A * 10/1964 Vick, Jr. ..... F04B 43/1133 417/474
3,814,547 A * 6/1974 Kitrilakis ..... A61M 60/837 417/430
3,857,651 A * 12/1974 Bruno ..... E02F 3/9243 417/171
3,951,572 A * 4/1976 Ray, Jr. ..... F04B 43/107 417/478
3,957,401 A * 5/1976 Sweeney ..... F04B 43/107 417/383
4,478,558 A * 10/1984 Owen ..... F04B 43/1133 417/296
8,133,035 B2 3/2012 Wolff
8,261,777 B2 * 9/2012 Doig ..... F04B 43/021 137/853
11,148,886 B2 10/2021 Johnson
2018/0215549 A1 8/2018 Johnson

OTHER PUBLICATIONS

Office Action in corresponding Chinese application No. 201980096913.9 dated Jan. 18, 2023.
Office Action in corresponding Chinese application No. 201980096913.9 dated Jun. 7, 2023.
"Pump", Hefei General Machinery Research Institute of the First Ministry of Machinery Industry, China Machine Press, Jan. 1980, p. 105.

* cited by examiner

CYCLIC OPERATING PUMPING METHOD AND SYSTEM

CROSS REFERENCE TO RELATED APPLICATIONS

The present application is a national stage of International patent application Serial No. PCT/EP2019/070022, filed Jul. 25, 2019, and published in English as WO 2021/013350.

BACKGROUND

Pumping certain materials can be challenging. For instance, in sub sea conditions, such as for the mining and transport to the surface of materials e.g. nodules and other deposits found on deep sea ocean floors, the material to be transported comprises solids present in a liquid, that is water.

SUMMARY

The present invention relates to a method of transporting a material, to a system of transporting a material, to a computer program to control the system accordingly, to a tube section and to a composition of such tube sections, in particular for use in the system and for applying the method respectively.

The material to be transported may be a more or less viscous substance in a horizontal or vertical system, but the method may also be applied in sub sea conditions, such as for the mining and transport to the surface of materials e.g. nodules and other deposits found on deep sea ocean floors. In that case the material to be transported comprises solids present in a liquid, that is water.

The present invention provides a method and accompanying system for effective transport of materials in general, with an emphasis on mining and lifting of nodules comprising useful compositions and metals.

Thereto a method has the features whereby a material is transported by at least one series of interconnected tube sections that can be opened or closed. At least one downstream tube section whereof holds the material to be transported. A liquid jet is generated which accelerates the held material upstream out of at least the first downstream tube section into at least one opening upstream tube section which then holds a material part waiting for a next liquid jet to propagate that part to the next upstream tube section.

Similarly the system for transporting material comprises:

- at least one series of interconnected tube sections capable of being opened or closed, whereby in operation tube sections of said series hold the material to be transported, and
- liquid jet generating means arranged in or embodied by the respective tube sections whereby the generated liquid jet accelerates material in at least a downstream tube section partly into an opening upstream tube section which then holds the material part.

The inventor had the notion that the pumping of a material comprising solids in a liquid can only be performed by accelerating the solids therein. Since the extent of acceleration is limited in practise a stop and go cycle is suggested wherein the solids in the material are sequentially being held, accelerated by means of a liquid jet and then again held, but now at least partly upstream in a next tube section. During the acceleration phase the solids which are normally heavier than the liquid they are in, do not get the time to sink. So the repeated cycle of holding, acceleration and holding of in particular the solids safeguards their successive movement upstream from one tube section to the next upstream tube section.

An embodiment of the method according to the invention has the features that by opening and closing the individually controlled tube sections, successive parts of the material confined between closed tube sections are stepwise transported through the series of interconnected tube sections.

By individually controlling the tube sections a stepwise sequential transport of at least one batch of material takes place. This advantageously leads to the possibility of successive batches being propelled during cycles in the series arrangement of successive tube sections. An even further advantage provides a parallel arrangement of such series if a higher yield of solids is required, such as may be the case in the mining of manganese nodules where the method is applied in a vertically aligned system in the deep sea. Such a parallel arrangement will turn out to have even further advantages in terms of pump efficiency because then pump actions in one series of tube sections and its neighbouring series may mutually operate in opposite phase.

A further embodiment of the method according to the invention which provides improved operational control of such repeated cycles has features that the interconnected tube sections which have a flexible inner tube fixed therein are controlled such that by pressurising or depressurizing a pressure space between the tube section and the flexible inner tube a resulting inward or outward flexing of the flexible inner tube closes or opens the respective tube sections.

Furthermore it is an advantage of the present invention that this embodiment of the control method and layout of the tube section may, either function as a controllable valve, or as a forcing pump, suction pump, that is a double acting pump for liquids with solids.

A still further embodiment of the method according to the invention has features that a liquid jet directed at the material to be transported is generated:

- through a pump driven nozzle in the tube section downstream relative to the held material, and/or
- by a tube section downstream relative to the held material which tube section has an inward flexing inner tube whose pressure space is pump driven.

It is an advantage of this method that the pump which will be a controllable pump may be embodied by a common controllable liquid pump.

Another embodiment of the method according to the invention has features that the pumps if attached to designated mainly vertically aligned tube sections act on the basis of a pressure difference relative to the local water pressure.

Under deep sea conditions to the water, having a depth dependent pressure, only a wanted pressure difference will have to be added by the pump, to propel the confined material over one or more tube sections, in which case a common centrifugal or gearwheel pump will suffice.

An embodiment of the system according to the invention has features that a flexible inner tube which is fixed in the tube section is a flexible inner tube which is flared radially outwardly in upstream direction.

This flaring promotes an unambiguous upstream directed flow of liquid and solids held by the downstream tube section into the upstream tube section, when the pressure space is pressurised.

A further embodiment of the system according to the invention has features that the system comprises a programmable processor capable of communicating a data address signal at least to the liquid jet generating means and the tube sections which are each uniquely addressable in order to generate successive jets with matching opening and closing actions of the tube sections, and which processor is programmed such that said material parts are urged upstream like a running wave from the ones to the next tube section.

The programmable control by the processor safeguards a smooth course of the necessary control actions in the system. Furthermore appropriate actions can be taken by means of operational software running in the processor, usually based on locally present sensors which provide actual control and timing parameter values.

BRIEF DESCRIPTION OF THE DRAWINGS

At present the features according to the inventions will be elucidated further together with their additional advantages while reference is being made to the appended drawings, wherein similar components are being referred to by means of the same reference numerals. In the drawings.

DETAILED DESCRIPTION

Figure 1:
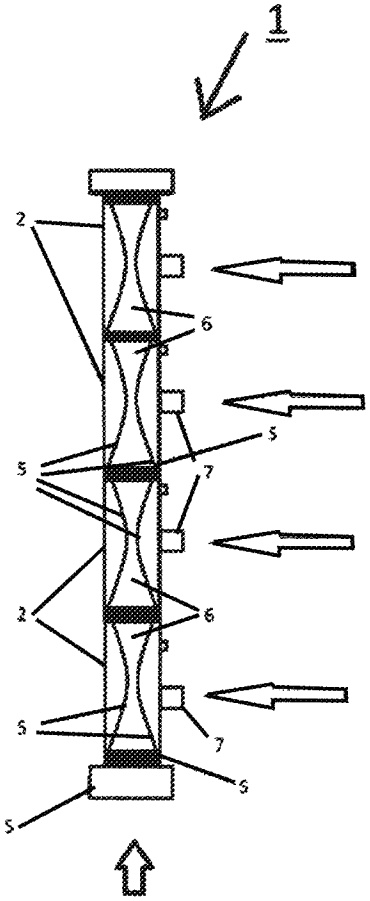
FIG. 1 shows a system according to the invention having interconnected controllable tube sections here in a vertical configuration.

FIG. 1 shows a system 1 for transporting material mainly in the form of a liquid, such as water, in particular sea water wherein solids, such as nodules, in particular manganese nodules are present. The system 1 comprises a series of interconnected tube sections 2, but if required the system 1 may comprise two or more parallel operating series of such tube sections 2. Each tube section 2 can be controlled to open or close which will be described further hereinafter. If installed in vertical configuration to be applied in water e.g. deep sea all sections 2 are open and are lowered into the water on their own weight till the bottom of the sea is reached by the most downstream tube section 2 which is then closed, as seen in row 2B of the matrix chart of FIG. 4. Narrower drawn tube sections 2A, 3C, 4E et cetera may be considered as non-return valves, but they may even be embodied by such multifunctional tube sections 2. Key with respect to the transport mechanism reflected by the chart is that at least part of the material confined between outer closed sections 2, is propagated between a closing most inner downstream section 2 and an upstream simultaneously opening most inner tube section 2. This will further be elucidated later.

Figure 2:
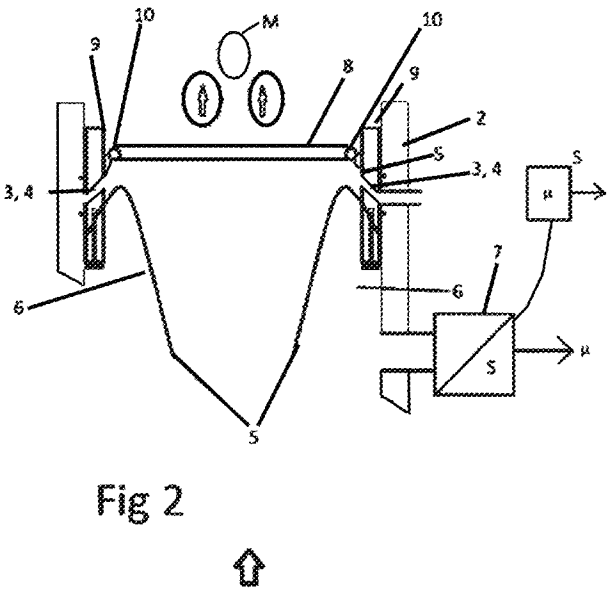
FIG. 2 shows a detail of a possible embodiment of a tube section according to the invention for use in the system of FIG. 1.

To at least promote some extra propagation of the material, liquid jet generating means 3 in the form of a pump driven nozzle 4 are positioned under the material M to be accelerated and are arranged in the tube section 2 as shown in FIG. 2.

Figure 4:
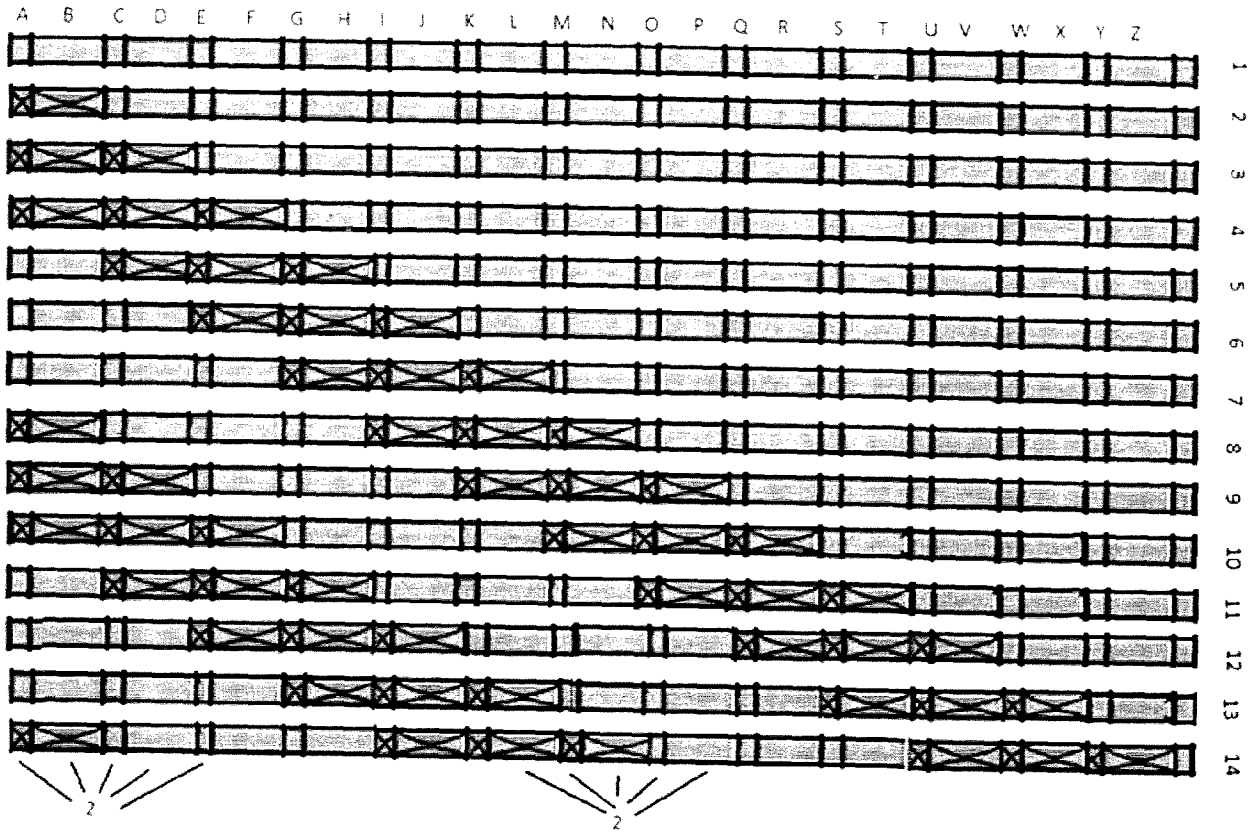
FIG. 4 shows a matrix chart of the system of FIG. 1 with interconnected tube sections depicted in a row denoted A-Z and in each column the open/closed state of the tube section in that row during the sequence of events denoted 1-14 while the material held is transported upstream.

Basic stepwise propagation in the direction of the arrows in FIG. 2 is however effected by the pressure action of the tube sections 2 which generate a liquid jet for tube section material to propagate, into so to say shift, into the simultaneously opening and material admitting/receiving upstream tube section 2. This way only the material which at its outer boundaries is confined between closed tube sections 2 is stepwise in a stop and go fashion transported from one section to the next. So limited amounts of pump energy are required for such stepwise movements wherein the solids are accelerated during each step. During a stop the water pressure inside the sections is made equal to the pressure of the water outside. This prevents water or gas escaping from the water or material to expand unwantedly. Multiple successive trains of confined material can travel through the series of tube sections 2 in a controlled way as seen in FIG. 4 or through a system 1 with several parallel connected series of tube sections.

In order to effect the pressure action the tube section 2 comprises a flexible inner tube 5 fixed in the downstream tube section 2. Between the tube section inner wall and the flexible inner tube 5 there is a pressure space 6 which may be pressurised or depressurized by means of a fluid liquid pump 7. The pump 7 which may also drive the nozzle 4 and may be a water pump which outputs possibly salt water having a pressure which is derived from the local water pressure at a depth where the tube sections 2 concerned are situated. In that case a limited amount of pump power is necessary since only the confined material needs to be lifted in each step which only requires a common centrifugal pump or a gearwheel pump. A pressurising of the space 6 results in an inward flexing of the flexible inner tube 5 forcing the material including water and solids within the flexible tube 5 out to the upstream tube section 2, as the tube section 2 directly downstream of that upstream section is closed. While a depressurizing results in an outward flexing ultimately against the inner wall of the section 2 which may suck in material but more importantly makes space for said forced out material part to enter the flexible inner tube 4 of the upstream inner tube section.

In order to propel and accelerate the material out of the tube section the flexible inner tube may be flared radially outwardly in upstream direction. Then pressurising the space 5 provides an extra force to drive the material into the next section.

Timing of the opening and closing of the various tube sections to get to a kind of stepwise running upstream wave of the material is effected by a programmable processor μ. The processor is capable of generally bidirectional communicating a data address signal via a bus structure like in a computer bus, at least to the liquid jet generating means 3, 4, the controllable tube sections 2 and valves, as well as to sensors S which measure critical parameter quantities. These addresses are unique in order to allow the processor μ to control each and every of the controllable components of the system 1 by means of a computer program and with the help of the sensor parameters. In particular opening and closing actions required for executing the method of transporting the material are properly programmed. Possibly these actions in particular their individual durations dependent on the operating depth of or the pressure in the tube sections 2, and the kind and size of material, as well as the viscosity and/or the solid to liquid ratio of the material and/or velocities and/or degree of filing of a section 2 may be input though the bus to the software concerned.

Figure 3:
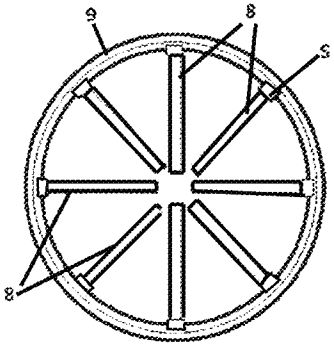
FIG. 3 shows a top view on one-wav means in the form of pivotally brackets mounted at one end of the tube section shown in FIG. 2.

The tube section 2 as shown in FIGS. 2 and 3 in top view comprise a one-way means 8 fixed therein for preventing solids in the material to move downstream. These means 8 are formed here as non-return brackets which in FIG. 2 pivot or possibly flex in upstream direction only. FIG. 2 shows that a mounting ring 9 is fixed to the inner wall of the tube section 2. The brackets pivot 10 is fixed to the inner wall via the ring 9 at the end of the section 2. Here the ring 9 also comprises the nozzle 4 and helps to effectively clamp an end part of the flexible inner tube 5. This eases production of the tube sections.

Returning to the chart of FIG. 4 it is best seen in rows 8-14 that in the case as shown there are three material filled sections 2 which are one by one gradually stepwise shifted—in this case upstream—to the right by the controlled closing and simultaneous opening of in this case the two inner sections which adjoin the confined material. Lesser or more sections may be filled with material which requires lesser or more local pump power and will influence the friction forces exerted on in particular the repeatedly flexing inner tube 5. It is also possible to confine the material section or sections between two or more sections on each side thereof, while the most inner sections are simultaneously closed and opened.

The invention claimed is:

1. A method of transporting a material comprises:

using at least one series of interconnected tube sections that can be opened or closed, the interconnected tube sections including a first downstream tube section and at least one opening upstream tube section;

holding the material to be transported in the first downstream tube section; and generating a liquid jet which accelerates the held material upstream wherein at least a part of the material is forced out of at least the first downstream tube section and into the at least one opening upstream tube section which then holds the part of the material waiting for a next liquid jet to propagate at least a further part of material to a next upstream tube section in that by opening and closing the interconnected tube sections selectively, successive parts of the material confined between closed tube sections are stepwise transported through the series of interconnected tube sections.

2. The method according to claim 1, wherein the interconnected tube sections are mainly horizontally configured.

3. The method according to claim 1, wherein generating the liquid jet directed at the material to be transported is generated through a pump driven nozzle in a tube section downstream relative to the held material.

4. The method according to claim 3, wherein the interconnected tube sections are vertically aligned, and wherein pumps act on a basis of a pressure difference relative to local water pressure.

5. The method according to claim 1, wherein the interconnected tube sections are mainly vertically configured.

6. A method of transporting a material comprises:

using at least one series of interconnected tube sections that can be opened or closed, the interconnected tube sections including a first downstream tube section and at least one opening upstream tube section, wherein the interconnected tube sections have a flexible inner tube fixed therein;

holding the material to be transported in the first downstream tube section;

generating a liquid jet which accelerates the held material upstream wherein at least a part of the material is forced out of at least the first downstream tube section and into the at least one opening upstream tube section which then holds the part of the material waiting for a next liquid jet to propagate at least a further part of material to a next upstream tube section; and pressurising or depressurising a pressure space between the interconnected tube sections and the flexible inner tube a resulting in inward or outward flexing of the flexible inner tube that closes or opens the respective tube sections.

7. A system for transporting material comprising:

at least one series of interconnected tube sections configured to be opened or closed, whereby in operation tube sections of said series hold the material to be transported, and a liquid jet generator arranged in or embodied by respective tube sections whereby a generated liquid jet accelerates material in at least a downstream tube section partly into an opening upstream tube section which then holds the material, wherein the liquid jet generator comprises a pump driven nozzle in the downstream tube section positioned under the material to be accelerated.

8. The system according to claim 7, and further comprising liquid pumps configured to operate on a group of mainly vertically aligned interconnected tube sections, wherein each liquid pump is a water pump which generates water having a pressure which is derived from a local water pressure at a depth where the group of mainly vertically aligned interconnected tube sections concerned are situated.

9. The system according to claim 7 wherein a flexible inner tube is fixed in at least one of the tube sections and which is flared radially outwardly in an upstream direction.

10. The system according to claim 7 and further comprising a programmable processor configured to communicate a data address signal at least to the liquid jet generator, wherein each tube section of the at least one series of interconnected tube sections is uniquely addressable in order to generate successive jets with matching opening and closing actions of the tube sections, and wherein the processor is programmed such that parts of the material are urged upstream.

11. The system according to claim 10 and further comprising sensors arranged to communicate with the processor for providing thereto operational quantities that include instantaneous liquid pressures and liquid velocities in each of the tube sections.

12. A computer program for use in the programmable processor according to claim 10.

13. The system of claim 7 wherein each of the downstream and upstream tube sections comprises a flexible inner tube having a pressure space that can be pressurised or, and which flexible inner tube when closing is arranged as a pump, to propel a liquid out of the flexible inner tube.

14. The system according to claim 7, and further comprising a one-way device configured to prevent solids in the material to move downstream.

15. The system according to claim 7, wherein the liquid jet generator comprises a flexible inner tube fixed in the downstream tube section whereby a pressure space between the tube section and the flexible inner tube is configured to be pressurised, resulting in an inward flexing of the flexible inner tube forcing the part of material out and into the upstream tube section.

16. A method of transporting a material comprises:

using at least one series of interconnected tube sections that can be opened or closed, the interconnected tube sections including a first downstream tube section and at least one opening upstream tube section;

holding the material to be transported in the first downstream tube section; and generating a liquid jet which accelerates the held material upstream wherein at least a part of the material is forced out of at least the first downstream tube section and into the at least one opening upstream tube section which then holds the part of the material waiting for a next liquid jet to propagate at least a further part of material to a next upstream tube section, wherein generating the liquid jet directed at the held material to be transported is generated by a tube section downstream relative to the held material, which tube section has an inward flexing inner tube configured to create a pressure space that is pump driven.

* * * * *